US010589523B2

(12) United States Patent
Anderson et al.

(10) Patent No.: US 10,589,523 B2
(45) Date of Patent: Mar. 17, 2020

(54) FLUID EJECTION DEVICE COMBINING DRIVE BUBBLE DETECT AND THERMAL RESPONSE

(71) Applicant: HEWLETT-PACKARD DEVELOPMENT COMPANY, L.P., Fort Collins, CO (US)

(72) Inventors: Daryl E Anderson, Corvallis, OR (US); Eric Martin, Corvallis, OR (US); James Gardner, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/318,214

(22) PCT Filed: Oct. 31, 2016

(86) PCT No.: PCT/US2016/059702
§ 371 (c)(1),
(2) Date: Jan. 16, 2019

(87) PCT Pub. No.: WO2018/080539
PCT Pub. Date: May 3, 2018

(65) Prior Publication Data

US 2019/0248131 A1 Aug. 15, 2019

(51) Int. Cl.
*B41J 2/045* (2006.01)
*B41J 2/14* (2006.01)
*B41J 2/175* (2006.01)

(52) U.S. Cl.
CPC ..... *B41J 2/0458* (2013.01); *B41J 2/04543* (2013.01); *B41J 2/04555* (2013.01);
(Continued)

(58) Field of Classification Search
CPC .. B41J 2/0458; B41J 2/04543; B41J 2/04555; B41J 2/04563; B41J 2/14153; B41J 2/175; B41J 2202/12
See application file for complete search history.

(56) References Cited

U.S. PATENT DOCUMENTS 6,460,964 B2 10/2002 Osborne
7,232,079 B2 6/2007 Courian et al.
(Continued)

FOREIGN PATENT DOCUMENTS

KR 20120125908 A 5/2011
WO WO-2015080709 A1 6/2015
(Continued)

OTHER PUBLICATIONS

Bruch, X., Extending Life of Thermal Inkjet Printheads for Commercial Applications, Sep. 2002, < http://www.imaging.org/IST/store/epub.cfm?abstrid=8179 >.

*Primary Examiner* — Thinh H Nguyen
(74) *Attorney, Agent, or Firm* — HP Inc. Patent Department

(57) ABSTRACT

A fluid ejection device with a fluid chamber including a vaporization chamber and a thermal drive bubble formation mechanism to vaporize a portion of a fluid in the vaporization chamber to form a drive bubble in response to a firing signal during a firing operation. A drive bubble detect sensor separate from the thermal drive bubble formation mechanism and in contact with fluid in the vaporization chamber, the drive bubble detect sensor to inject a fixed current through the vaporization chamber to generate a first voltage signal representing a voltage response of the vaporization chamber and indicative of drive bubble formation during the firing operation. A thermal sensor to generate a second voltage signal indicative of a thermal response of the vaporization chamber during the firing operation, the first and
(Continued)

second voltage signals combined being representative of an operating condition of the fluid chamber.

15 Claims, 9 Drawing Sheets

(52) U.S. Cl.
CPC ..... *B41J 2/04563* (2013.01); *B41J 2/14153* (2013.01); *B41J 2/175* (2013.01); *B41J 2202/12* (2013.01)

(56) References Cited

U.S. PATENT DOCUMENTS

| | | | | |
|---|---|---|---|---|
| 7,287,824 | B2 | 10/2007 | Subirada et al. | |
| 8,336,981 | B2 | 12/2012 | Chen et al. | |
| 9,044,936 | B2 | 1/2015 | Van Brocklin et al. | |
| 9,493,002 | B2 * | 11/2016 | Edelen | B41J 2/0458 |
| 2009/0040258 | A1 | 2/2009 | Baek | |

FOREIGN PATENT DOCUMENTS

| | | | |
|---|---|---|---|
| WO | WO-2015102639 | A1 | 7/2015 |
| WO | WO-2015191060 | A1 | 12/2015 |
| WO | WO-2016066728 | A1 | 5/2016 |

* cited by examiner

FLUID EJECTION DEVICE COMBINING DRIVE BUBBLE DETECT AND THERMAL RESPONSE

BACKGROUND

Fluid ejection devices typically include a number of fluid chambers which are in fluid communication with and receiving fluid from a fluid source, such as a fluid slot, via fluid passages. Typically, fluid chambers are one of two types, referred to generally as ejection chambers and non-ejection chambers. Ejection chambers, also referred to as "drop generators" or simply as "nozzles", include a vaporization chamber having a nozzle or orifice and a drive bubble formation mechanism, such as a firing resistor, for example. When energized, the fluid ejector of a nozzle vaporizes fluid within the vaporization chamber to form a drive bubble which causes a drop of fluid to be ejected from the nozzle. Non-ejection chambers, also referred to as "recirculating pumps" or simply as "pumps", also include a vaporization chamber and a fluid ejector, but do not include a nozzle. When energized, the fluid ejector of a pump also vaporizes fluid with the vaporization chamber to form a drive bubble, but since there is no nozzle, the drive bubble causes fluid to be "pumped" recirculated through associated fluid passages from the fluid slot to keep associated nozzles supplied with fresh fluid.

DETAILED DESCRIPTION

Figure 1:
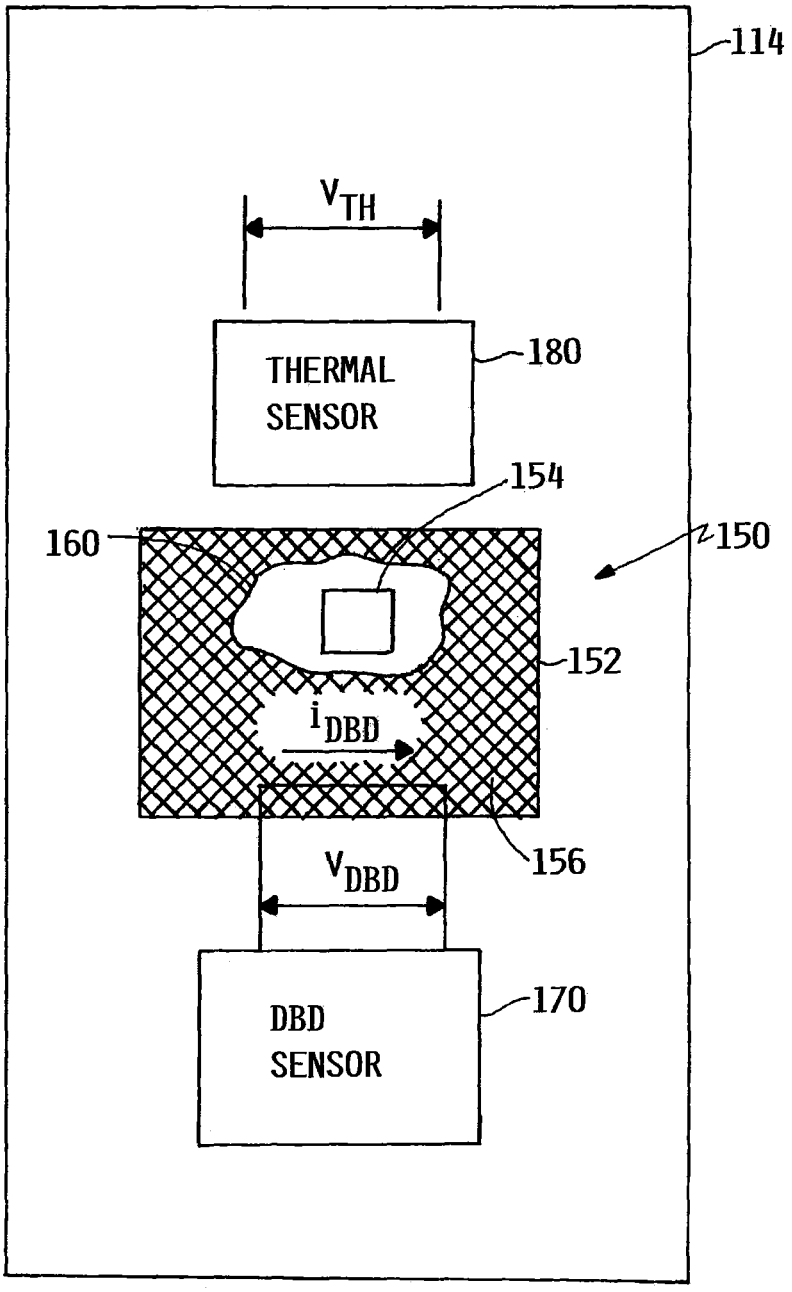
FIG. 1 is a bock and schematic diagram generally illustrating fluid ejection device combining drive bubble detect and thermal response, according to one example.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Fluid ejection devices typically include a number of fluid chambers which are in fluid communication with and receiving fluid from a fluid source, such as a fluid slot, via fluid passages. Typically, fluid chambers are one of two types, referred to generally as ejection chambers and non-ejection chambers. Ejection chambers, also referred to as "drop generators" or simply as "nozzles", include a vaporization chamber having a nozzle or orifice and a drive bubble formation mechanism, such as a thermal drive bubble formations mechanism (e.g., a firing resistor), for example. When energized, the firing resistor of a nozzle vaporizes at least components on the fluid within the vaporization chamber to form a drive bubble, wherein the drive bubble causes a drop of fluid to be ejected from the nozzle. Non-ejection chambers, also referred to as "recirculating pumps" or simply as "pumps", also include a vaporization chamber and a firing resistor, but do not include a nozzle. When energized, the firing resistor of a pump also vaporizes fluid with the vaporization chamber to form a drive bubble, but since there is no nozzle, rather than eject a drop of fluid, the drive bubble causes fluid to be "pumped" or recirculated through associated fluid passages from the fluid slot to keep associated nozzles supplied with fresh fluid.

Typically, the fluid chambers of a fluid ejecting device are arranged into groups of fluid chambers referred to as primitives, with the primitives further being organized into columns, with each primitive receiving a same set of addresses, and each fluid chamber of a primitive corresponding to a different one of the address of the set of addresses. In one example, ejection data to control the operation of the firing resistors to selectively eject fluid drops from nozzles in a desired pattern (e.g., print data to form a printed image, such as on a print medium, in the case of an inkjet printhead) is provided to the fluid ejection device in the form of a series of nozzle column data groups (NCGs), or more generally ejection column groups. Each NCG includes a series of fire pulse groups (FPGs), where each FPG corresponds to an address of the set of addresses and includes a set of ejection or firing bits, with each firing bit of each corresponding to a different primitive.

During fluid ejection operations, conditions may develop that adversely affect the ability of nozzles and/or pumps to properly eject fluid drops or to pump fluid. For example, a blockage, either partial or complete, may occur in a fluid passage, vaporization chamber, or nozzle, or fluid (or components of the fluid) may solidify on the drive bubble formation mechanism. In order to detect such conditions so that appropriate adjustments can be made (e.g., nozzle wiping), techniques, such as optical drop detect and drive bubble detect (DBD), have been developed to monitor on-going operating characteristics of the fluid chambers so to assess whether fluid chambers are operating properly (monitoring the "health" of the fluid chambers).

According to one example, DBD includes injecting a fixed current through a fluid chamber during the formation and collapse of a drive bubble. An impedance path is formed through fluid and/or vaporized gaseous materials of a drive bubble at least within the vaporization chamber with a resulting voltage generated across the impedance path being indicative of an operating condition of the fluid chamber. Drive bubble formation and collapse (sometimes referred to as a firing operation) takes place over a period of time, such as 10 μs, for example. By measuring the resulting voltage at a selected time during the generation/collapse of a drive bubble and comparing the measured voltage to known voltage profiles representative of different nozzle conditions, a current condition of the fluid chamber can be determined. For example, a first DBD voltage profile may be indicative of a "healthy" fluid chamber (i.e., where the fluid chamber is operating properly with no blockages), a second DBD voltage profile may be indicative of a 60% of an orifice from which fluid drops are ejected, a third DBD voltage maybe indicative of a 66% blockage of a fluid inlet or passage to the fluid chamber, a fourth DBD voltage profile may be indicative of a complete blockage (e.g., no fluid in the vaporization chamber during a firing operation), etc. Any number of such voltage profiles may be generated for known conditions and stored in a memory, for example.

Typically, due to time constraints, only a limited number of DBD voltage measurements are able to be made during a fluid chamber firing operation (e.g., with the 10 μs window). For example, often only one DBD voltage measurement is able to be taken during a firing operation. While the above-described profiles may be distinct from one another at certain times during drive bubble formation/collapse, at other times, the profiles may be similar. As such, depending on when a DBD measurement is taken during a firing operation, it may be difficult to accurately determine a condition of a fluid chamber indicated by the measurement. For instance, a measurement taken during drive bubble formation may not be definitively indicative of whether a nozzle is healthy or partially blocked, say 60% blocked, for example. Other types of defects may also difficult to differentiate, such as particles trapped in the vaporization chamber, or residue buildup on components of the fluid chamber, for example.

FIG. 1 is block and schematic diagram generally an example of a fluid ejection device 114, in accordance with the present disclosure, which provides both DBD measurements and a thermal response of a fluid chamber. As will be described in greater detail below, while a thermal response may not be indicative of a particular condition of a fluid chamber (e.g., whether a nozzle is partially or completely blocked), the thermal response provides a binary indication of whether a fluid chamber is "healthy" or blocked to some degree. Thus, as described below, combining a DBD voltage response with a thermal response provides a more definitive assessment of a fluid chamber condition indicated by a DBD voltage response.

In the illustrated example of FIG. 1, fluid ejection device 114 includes a fluid chamber 150, a DBD sensor 170, and a thermal sensor 180. Fluid chamber 150 includes a vaporization chamber 152 and a thermal drive bubble formation mechanism 154 (e.g., a firing resistor) to vaporize a portion of a fluid 156 (e.g., ink) in vaporization chamber 152 to form a drive bubble 160 in response to a firing signal during a firing operation. DBD sensor 170 is separate from the thermal drive bubble formation mechanism 154 and is in contact with fluid 156 in vaporization chamber 152. In one example, DBD sensor 170 injects a fixed current, $i_{DBD}$, through vaporization chamber 52 to generate a first voltage signal, $V_{DBD}$, indicative of formation of drive bubble 160 in vaporization chamber during 152 the firing operation.

Thermal sensor 180 provides a second voltage signal, $V_{TH}$, indicative of a thermal response of vaporization chamber 152 to the firing operation. In one example, thermal sensor 180 provides second voltage signal, $V_{TH}$, subsequent to DBD sensor 170 providing first voltage signal, $V_{DBD}$. In one example, thermal sensor 180 provided second voltage signal, $V_{TH}$, during a firing operation different from a firing operating during which DBD sensor 170 provide first voltage signal, $V_{DBD}$.

As will be described in greater detail below, DBD voltage response, $V_{DBD}$, and the thermal voltage response, $V_{TH}$, together are representative of an operating condition of the fluid chamber 114, such as whether fluid chamber 114 is operating properly, is partially blocked, or fully blocked, for instance. For example, in a properly functioning or "healthy" fluid chamber, as a heated drop of fluid 158 is ejected, cool fluid from fluid slot 153 refills vaporization chamber 152, whereas for a fluid chamber 150 that is blocked, heated fluid will not eject properly so that cool ink will not refill vaporization chamber 152 in the same fashion as a healthy fluid chamber 150. As a result, such fluid chambers will have different temperature profiles over the duration of a firing operation.

Although illustrated as having only a single fluid chamber 150, as will be described in greater detail below, it is noted that fluid ejection device 114 may include any number of fluid chambers 150, with each fluid chamber 150 including DBD and thermal sensing as described above (see FIGS. 7 and 8, for example).

Figure 2:
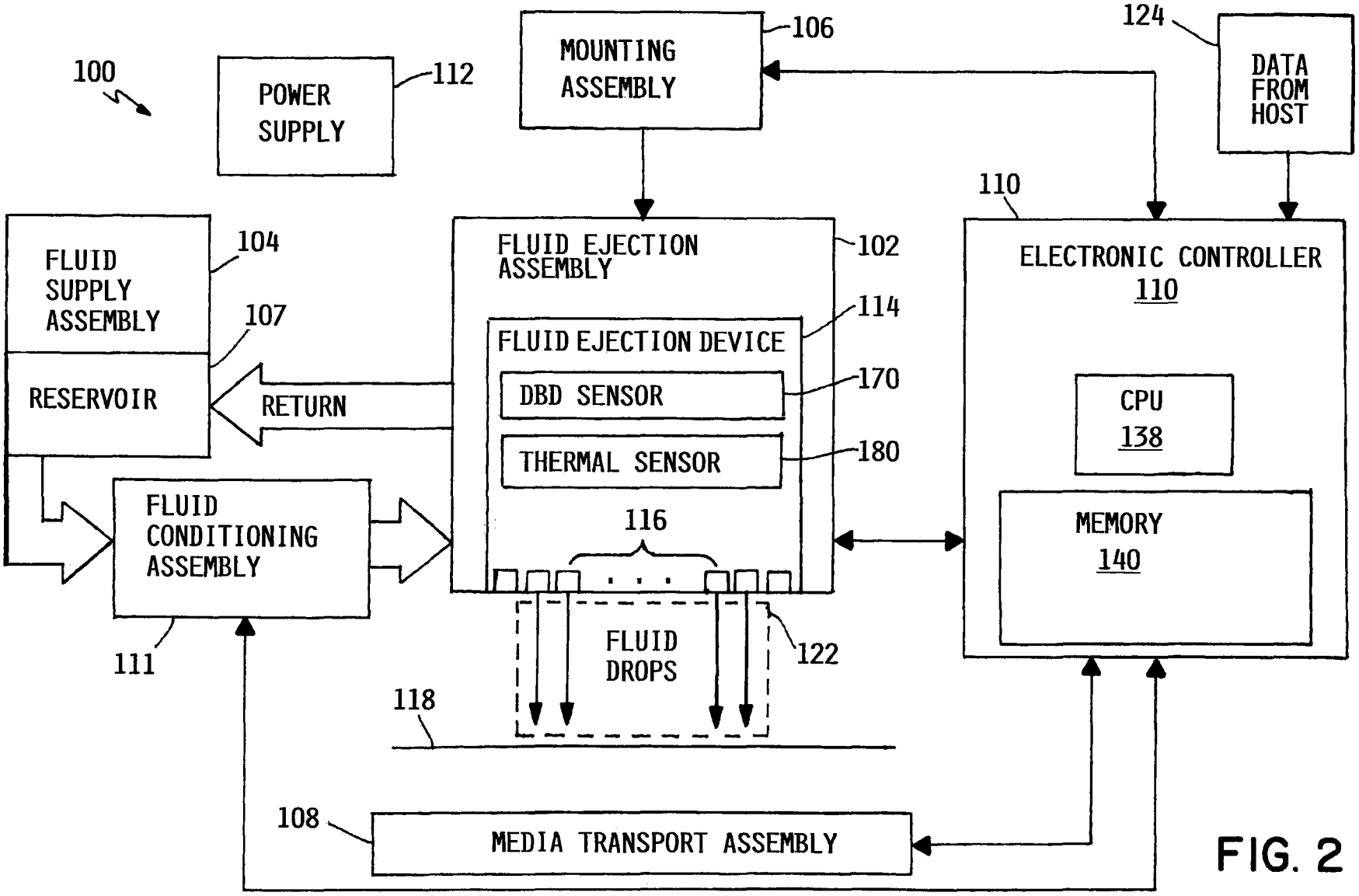
FIG. 2 is a block and schematic diagram illustrating a fluid ejection system including a fluid ejection device combining drive bubble detect and thermal response, according to one example.

FIG. 2 is a block and schematic diagram illustrating generally a fluid ejection system 100 including a fluid ejection device, such as a fluid ejection assembly 102, including a fluid ejection device 114 having a DBD sensor 170 and a thermal sensor 180, in accordance with the present application, to provide DBD voltage response and thermal response measurements for selected fluid chambers of fluid ejection device 114, as will be described in greater detail below.

In addition to fluid ejection assembly 102 and fluid ejection device 114, fluid ejecting system 100 includes a fluid supply assembly 104 including an fluid storage reservoir 107, a mounting assembly 106, a media transport assembly 108, an electronic controller 110, and at least one power supply 112 that provides power to the various electrical components of fluid ejecting system 100.

Fluid ejection device 114 ejects drops of fluid through a plurality of orifices or nozzles 116, such as onto a print media 118. According to one example, as illustrated, fluid ejection device 114 may be implemented as an inkjet printhead 114 ejecting drops of ink onto print media 118. Fluid ejection device 114 includes orifices 116, which are typically arranged in one or more columns or arrays, with groups of nozzles being organized to form primitives, and primitives arranged into primitive groups. Properly sequenced ejections of fluid drops from orifices 116 result in characters, symbols or other graphics or images being printed on print media 118 as fluid ejecting assembly 102 and print media 118 are moved relative to one another.

Although broadly described herein with regard to a fluid ejection system 100 employing a fluid ejection device 114, fluid ejection system 100 may be implement as an inkjet printing system 100 employing an inkjet printhead 114, where inkjet printing system 100 may be implemented as a drop-on-demand thermal inkjet printing system with inkjet printhead 114 being a thermal inkjet (TIJ) printhead 114. Additionally, the inclusion of DBD operations data in PCGs, according to the present disclosure, can be implemented in other printhead types as well, such wide array of TIJ printheads 114 and piezoelectric type printheads, for example. Furthermore, the inclusion of DBD operations data in PCGs, in accordance with the present disclosure, is not limited to inkjet printing devices, but may be applied to any digital fluid dispensing device, including 2D and 3D printheads, for example.

Referencing FIG. 2, in operation, fluid typically flows from reservoir 107 to fluid ejection assembly 102, with fluid supply assembly 104 and fluid ejection assembly 102 forming either a one-way fluid delivery system or a recirculating fluid delivery system. In a one-way fluid delivery system, all of the supplied to fluid ejection assembly 102 is consumed during printing. However, in a recirculating fluid delivery system, only a portion of the fluid supplied to fluid ejection assembly 102 is consumed during printing, with fluid not consumed during printing being returned to supply assembly 104. Reservoir 107 may be removed, replaced, and/or refilled.

In one example, fluid supply assembly 104 supplies fluid under positive pressure through an fluid conditioning assembly 11 to fluid ejection assembly 102 via an interface connection, such as a supply tube. Fluid supply assembly includes, for example, a reservoir, pumps, and pressure regulators. Conditioning in the fluid conditioning assembly may include filtering, pre-heating, pressure surge absorption, and degassing, for example. Fluid is drawn under negative pressure from fluid ejection assembly 102 to the fluid supply assembly 104. The pressure difference between an inlet and an outlet to fluid ejection assembly 102 is selected to achieve correct backpressure at orifices 116.

Mounting assembly 106 positions fluid ejection assembly 102 relative to media transport assembly 108, and media transport assembly 108 positions print media 118 relative to fluid ejection assembly 102, so that a print zone 122 is defined adjacent to orifices 116 in an area between fluid ejection assembly 102 and print media 118. In one example, fluid ejection assembly 102 is scanning type fluid ejection assembly. According to such example, mounting assembly 106 includes a carriage for moving fluid ejection assembly 102 relative to media transport assembly 108 to scan fluid ejection device 114 across printer media 118. In another example, fluid ejection assembly 102 is a non-scanning type fluid ejection assembly. According to such example, mounting assembly 106 maintains fluid ejection assembly 102 at a fixed position relative to media transport assembly 108, with media transport assembly 108 positioning print media 118 relative to fluid ejection assembly 102.

Electronic controller 110 includes a processor (CPU) 138, a memory 140, firmware, software, and other electronics for communicating with and controlling fluid ejection assembly 102, mounting assembly 106, and media transport assembly 108. Memory 140 can include volatile (e.g. RAM) and nonvolatile (e.g. ROM, hard disk, floppy disk, CD-ROM, etc.) memory components including computer/processor readable media that provide for storage of computer/processor executable coded instructions, data structures, program modules, and other data for fluid ejection system 100.

Electronic controller 110 receives data 124 from a host system, such as a computer, and temporarily stores data 124 in a memory. Typically, data 124 is sent to fluid ejection system 100 along an electronic, infrared, optical, or other information transfer path. In one example, when fluid ejection system 100 is implemented as an inkjet printing system 100, data 124 represents a file to be printed, such as a document, for instance, where data 124 forms a print job for inkjet printing system 100 and includes one or more print job commands and/or command parameters.

In one implementation, electronic controller 110 controls fluid ejection assembly 102 for ejection of fluid drops from orifices 116 of fluid ejection device 114. Electronic controller 110 defines a pattern of ejected fluid drops to be ejected from orifices 116 and which, together, in the case of being implemented as an inkjet printhead, form characters, symbols, and/or other graphics or images on print media 118 based on the print job commands and/or command parameters from data 124.

Figure 3A:
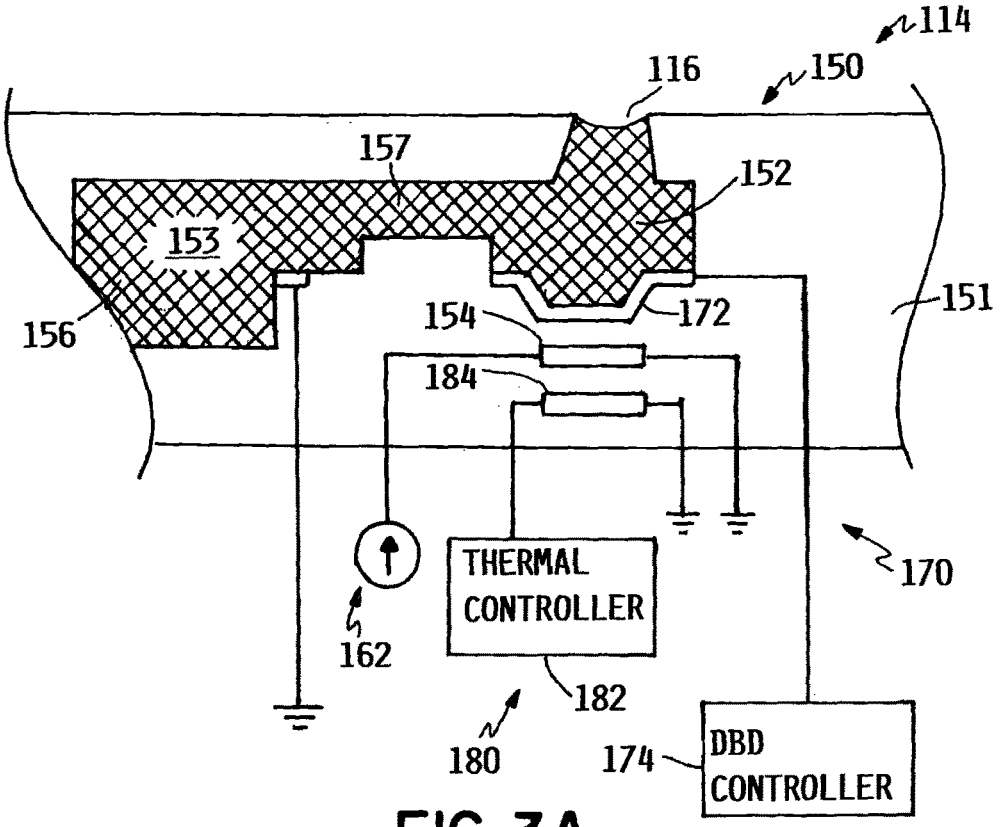
FIG. 3A is a schematic diagram generally illustrating a fluid chamber combining drive bubble detect and thermal response, according to one example.
Figure 3B:
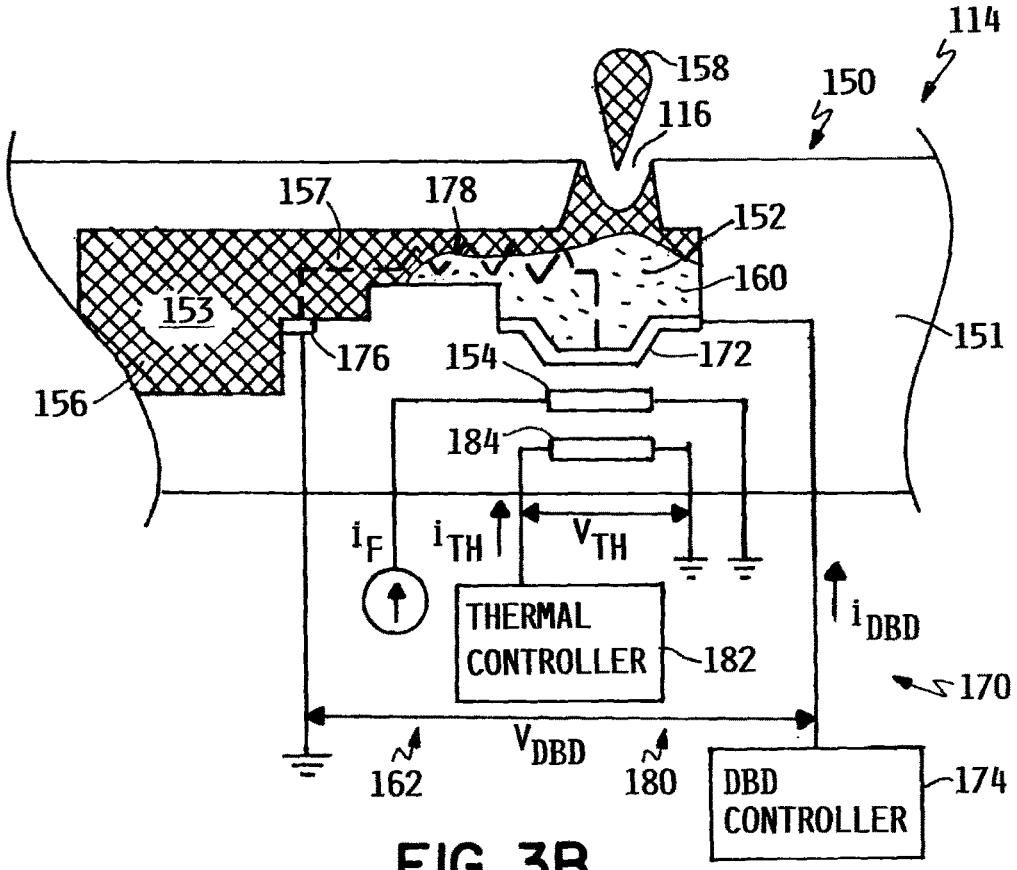
FIG. 3B is a schematic diagram generally illustrating a fluid chamber combining drive bubble detect and thermal response, according to one example.

FIGS. 3A and 3B are block and schematic diagrams generally showing a cross-sectional view of a portion of fluid ejection device 114 and illustrating an example of a fluid chamber 150. Fluid chamber 150 is formed in a substrate 151 of fluid ejection device 114, and includes vaporization chamber 152 which is in liquid communication with a feed slot 153 via a feed channel 157 which communicates fluid 156 (illustrated as a "shaded or cross-hatched region") from feed slot 1534 to vaporization chamber 152. A nozzle or orifice 116 extends through substrate 151 to vaporization chamber 152.

In one example, thermal drive bubble formation mechanism 154 of fluid chamber 150 is disposed in substrate 151 below vaporization chamber 152. In one example, thermal drive bubble formation mechanism is a firing resistor 154. Firing resistor 154 is electrically coupled to ejection control circuitry 162 which controls the application of an electrical current to firing resistor 154 to form drive bubbles 160 within vaporization chamber 152 to eject fluid drops from nozzle 16. It is noted that fluid chamber 150 of FIGS. 3A and 3B is illustrated as being implemented an "ejection-type chamber", referred to simply as a "nozzle", which ejects ink drops from orifice 116. In other examples, fluid chamber 150 may be implemented as a "non-ejection-type chamber", referred to as a "pump", which does not include an orifice 116.

In one example, ejection chamber 150 includes a metal plate 172 (e.g. a tantalum (Ta) plate) which is disposed above firing resistor 154 and in contact with fluid 156 (e.g., ink) within vaporization chamber 152, and which protects underlying firing resistor 154 from cavitation forces resulting from the generation and collapse of drive bubbles 160 within vaporization chamber 152. In one example, metal plate 172 serves as a DBD sense plate 172 for DBD sensor 170, with DBD sensor 170 further including a DBD controller 174 and a ground point 176 exposed to fluid 156 within vaporization chamber 152, fluid slot 153, and passage 157.

In one example, thermal sensor 180 includes a thermal controller 180 and a thermal sense element 184. In one example, thermal sense element 184 is a thermal diode 184. In one example, thermal sense element 184 is a thin film metal resistor. In one example, thermal sense element 184 is any suitable device having an impedance, voltage or current response which is temperature dependent. In one example, thermal diode 184 is disposed in substrate 151 below firing resistor 154, so that firing resistor 154 is disposed between DBD sense plate 172 and thermal diode 184.

With reference to FIG. 3B, during fluid ejection or firing operations, ejection control circuitry 162 provides a firing current $i_F$ to firing resistor 154, which evaporates at least one component (e.g., water) of fluid 156 to form a gaseous drive bubble 160 in vaporization chamber 152. As gaseous drive bubble 160 increases in size, pressure increases in vaporization chamber 152 until a capillary restraining force retaining fluid within vaporization chamber 152 is overcome and a fluid droplet 158 is ejected from nozzle or orifice 116. Upon ejection of fluid droplet 158, drive bubble 160 collapses, heating of firing resistor 154 is ceased, and fluid 156 flows from slot 153 to refill vaporization chamber 152.

As described above, conditions may develop during operation that adversely affect the ability of fluid chamber 150 to properly form drive bubbles 160 and/or eject fluid droplets 158. For example, blockages (either partial or complete) may occur in orifice 116, vaporization chamber 152, vaporization chamber 152, or components of fluid 156 make become solidified on surfaces of fluid chamber 150 which affect the ability of firing resistor 154 to properly heat fluid 156. Conditions may also arise with ejection control circuitry 162, including firing resistor 154, that result in a failure or in proper formation of drive bubbles 160. Such conditions may result in improper firing of nozzle 150, such as a failure to fire (i.e., no fluid droplet is ejected), firing early, firing late, releasing too much fluid, releasing too little fluid, or mis-directing fluid drops, among others, for example.

As described above, DBD is one technique for monitoring the formation and ejection of drive bubbles 160 within vaporization chamber 152 in order to assess the operating conditions or "health" of ejection chamber 150, including vaporization chamber 152, fluid passage 157, nozzle 116, and other components, such as firing resistor 154, for example. According to one example, to perform a DBD operation, as ejection control circuitry 162 provides a firing current $i_F$ to firing resistor 154, firing resistor 154 begins heating fluid 156 within ejection chamber 150 and begins evaporate at least one component of fluid 156 (e.g., water) and begins forming a drive bubble 160.

In one example, at a selected time after commencement of the firing operation, for instance, when drive bubble 160 is expected to have formed, but before ejection of ink drop 158 (i.e., before collapse of drive bubble 160) DBD controller 174 provides a fixed sense current, $i_{DBD}$, to DBD sense plate 172, Sense current $i_{DBD}$ flows through an impedance path 178 formed by fluid 156 and/or the gaseous material of drive bubble 160 to ground point 176, resulting in generation of a DBD voltage, $V_{DBD}$, which is indicative of the characteristics of drive bubble 160 which, in-turn, is indicative of the operating condition or "health" fluid chamber 150.

The magnitude of $V_{DBD}$ changes based on a size of drive bubble 160. For example, as drive bubble 170 expands during formation, more of DBD sense plate 172 is in contact with drive bubble 170 so that the relative portions of impedance path 178 formed by fluid 156 and drive bubble 160 change over time, which results in changes in the impedance of impedance path 178 and, which in-turn, results in changes in the magnitude of chamber voltage $V_{DBD}$. As such, a magnitude of $V_{DBD}$ measured by DBD sensor 170 will vary depending on when the DBD measurement is taken during a firing operation.

In one example, DBD controller 174 measures $V_{DBD}$ at selected times during a firing operation of fluid chamber 150 (i.e., during the formation and collapse of drive bubble 160 and a time period thereafter). In one example, DBD controller 174 measures $V_{DBD}$ at one point during a given firing operation. In one example, DBD controller 174 measures $V_{DBD}$ at a different time during each of a series of firing operations.

According to one example, which will be described in greater detail below, DBD controller 174 provides the measured values of $V_{DBD}$ to a controller, such as a controller 110 (see FIG. 8, for example), which compares the measured values of $V_{DBD}$ to known voltage profiles of chamber voltages $V_{DBD}$ which are indicative of various conditions of fluid chambers 150 (e.g., healthy nozzle, partially blocked nozzle, fully blocked nozzle) in order to assess the operating condition of the fluid chamber and determine whether a fluid chamber is "healthy" or defective. If it is determined that a fluid chamber 150 is misfiring (i.e., operating with some type of defect), the controller, such as controller 110, may implement servicing procedures or remove the fluid chamber 150 from service and compensate by adjusting firing patterns of remaining fluid chambers, for instance.

Figure 4:
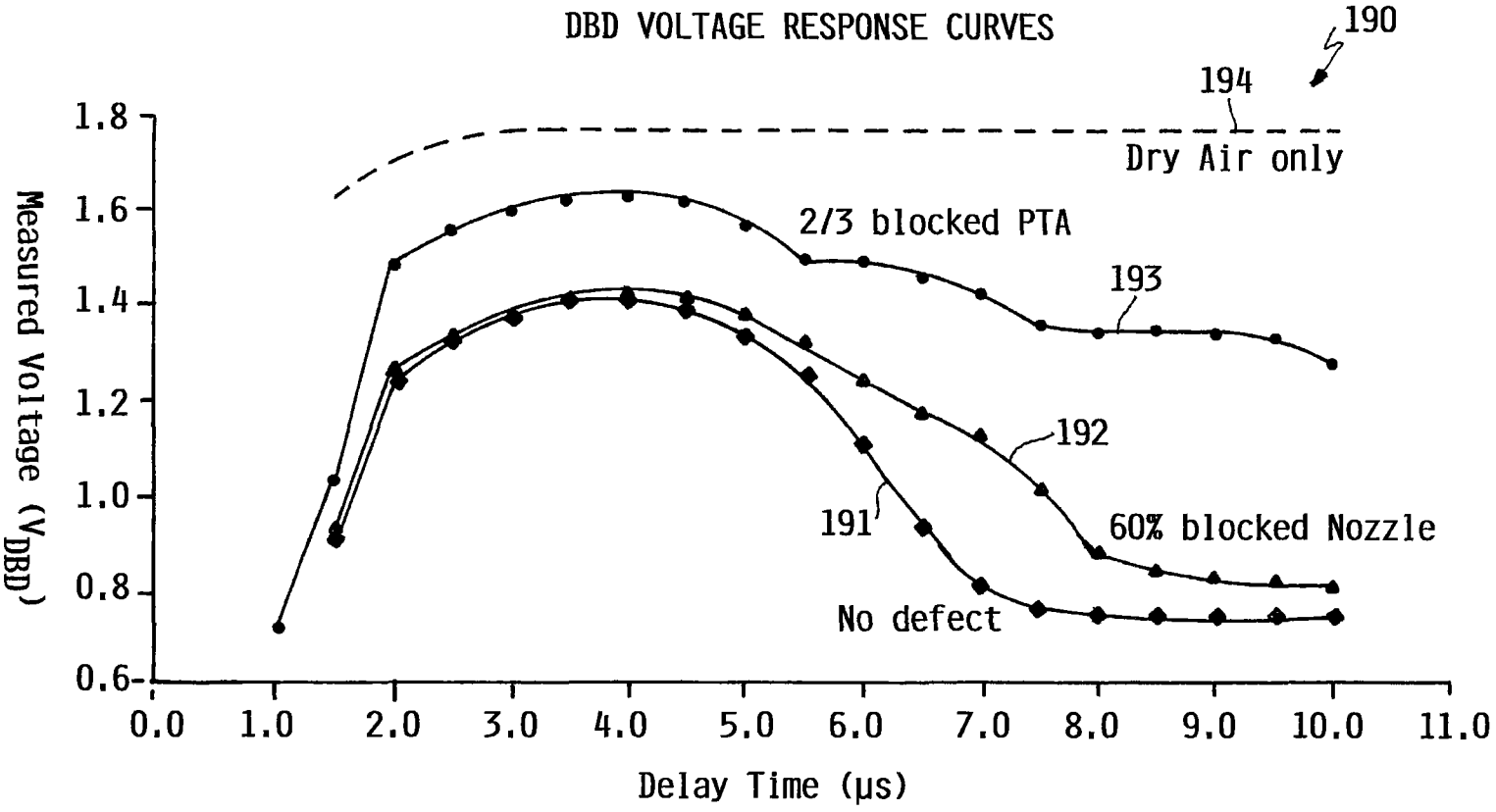
FIG. 4 is a graph generally illustrating drive bubble detect voltage response curves of known operating conditions of a fluid chamber, according to one example.

FIG. 4 is a graph 190 illustrating examples of known DBD voltage response curves during a firing operation of a fluid chamber 150, and representing known operating conditions thereof. Curve 191 represents an example of a $V_{DBD}$ response of a fluid chamber 150 that has no defects and is operating properly. Curve 192 represents an example of a $V_{DBD}$ response of a fluid chamber 150 that has a nozzle or orifice 116 that is 60% blocked. Curve 193 represents an example of a $V_{DBD}$ response of a fluid chamber 150 having a fluid inlets (e.g., fluid passages 157) which are 66% blocked. In one example, fluid chamber 150 includes three fluid passages 157, with curve 193 representing a scenario where two the three passages are blocked. Curve 194 represents an example of a $V_{DBD}$ response of a fluid chamber 150 that is completely blocked and has only air within vaporization chamber 152.

Depending on a value of a $V_{DBD}$ measurement, it may be difficult to reliably and accurately determine the operating condition of a fluid chamber. For example, with reference to FIG. 4, if a $V_{DBD}$ measurement taken at 6.5 μs after the beginning of a firing operation has a value of 1.1, it is difficult to determine whether the fluid chamber has no defects (curve 191) or whether the fluid chamber has an orifice that is 60% blocked (curve 192). Similarly, if a $V_{DBD}$ measurement taken at 6.5 μs after the beginning of a firing operation has a value of 1.3, it is difficult to determine whether the fluid chamber has an orifice 116 that is 60% blocked (curve 192) or whether a fluid passage of fluid chamber is 66% blocked (curve 193). As such, uncertainties may exist when determining the operating condition of a fluid chamber based on measured values of $V_{DBD}$.

With reference to FIG. 3B, in accordance with one example of the present disclosure, in order to better determine operating conditions a fluid chambers 150, a thermal response of fluid chamber is also measured. In one example, at a selected time after commencement of the firing operation, for instance, when drive bubble 160 is expected to have formed and already collapsed (i.e. after an ink droplet 158 is expected to have been ejected in the case of an ejection chamber, or after ink is expected to have been re-circulated in the case of a pumping chamber), thermal controller 182 provides a fixed sense current, $i_{TH}$, to thermal element 184 (e.g., a thermal diode). Sense current $i_{TH}$ flows through thermal element 184 and generates of a thermal voltage, $V_{TH}$, which is indicative of an operating temperature of fluid chamber 150 and, as described below, is indicative of the operating condition or "health" fluid chamber 150.

A thermal response of a fluid chamber will vary based on factors such as whether a drive bubble 160 formed over firing resistor 154 (i.e., heater), for long such a drive bubble 160 existed, and whether a fluid drop 158 was ejected from vaporization chamber 152 (during either pumping or ejection from orifice 116, causing fresh, and cooler, fluid to enter vaporization chamber 152 from fluid slot 153). For example, if a drive bubble 160 failed to form, thermal element 184 will register a higher peak temperature due to thermal energy not being carried away with an ejected fluid drop or circulated fluid. The more times firing resistor 154 is fired within a given time period, the greater the peak temperature that will be registered.

Figure 5:
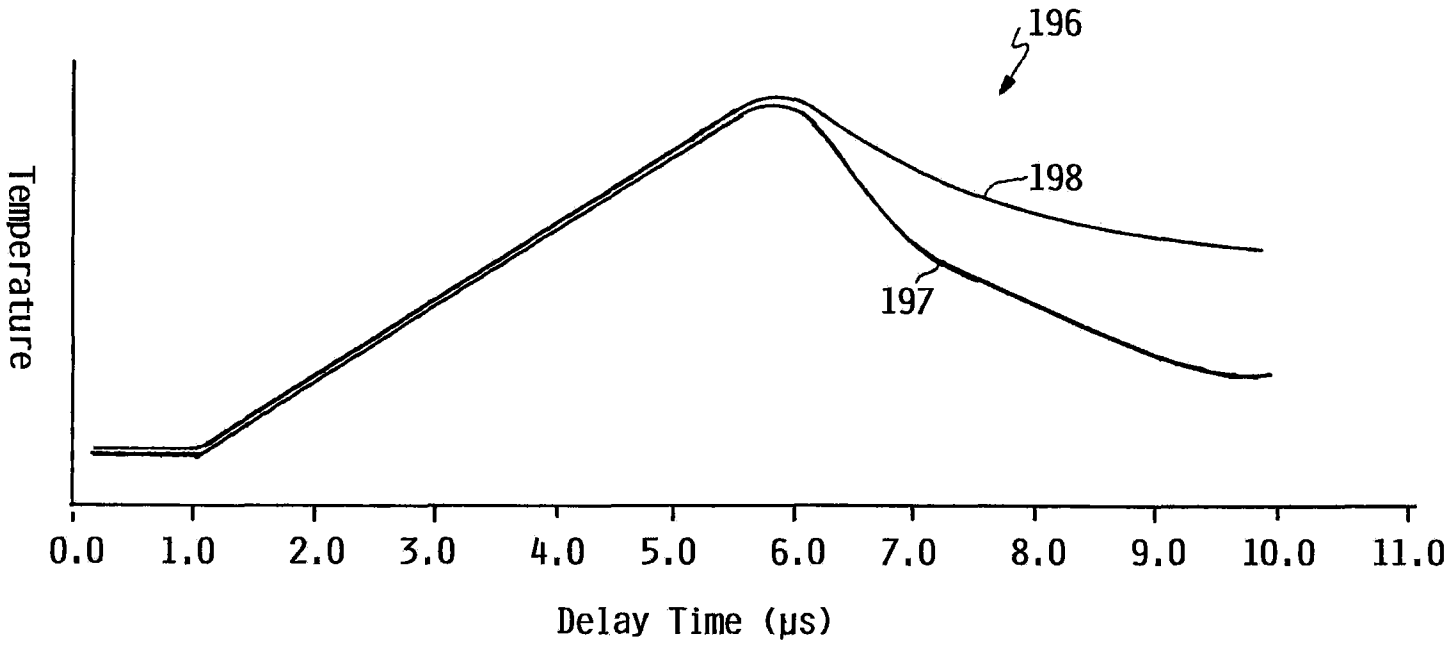
FIG. 5 is a graph generally illustrating thermal response curves of known operating conditions of a fluid chamber, according to one example.
Figure 6:
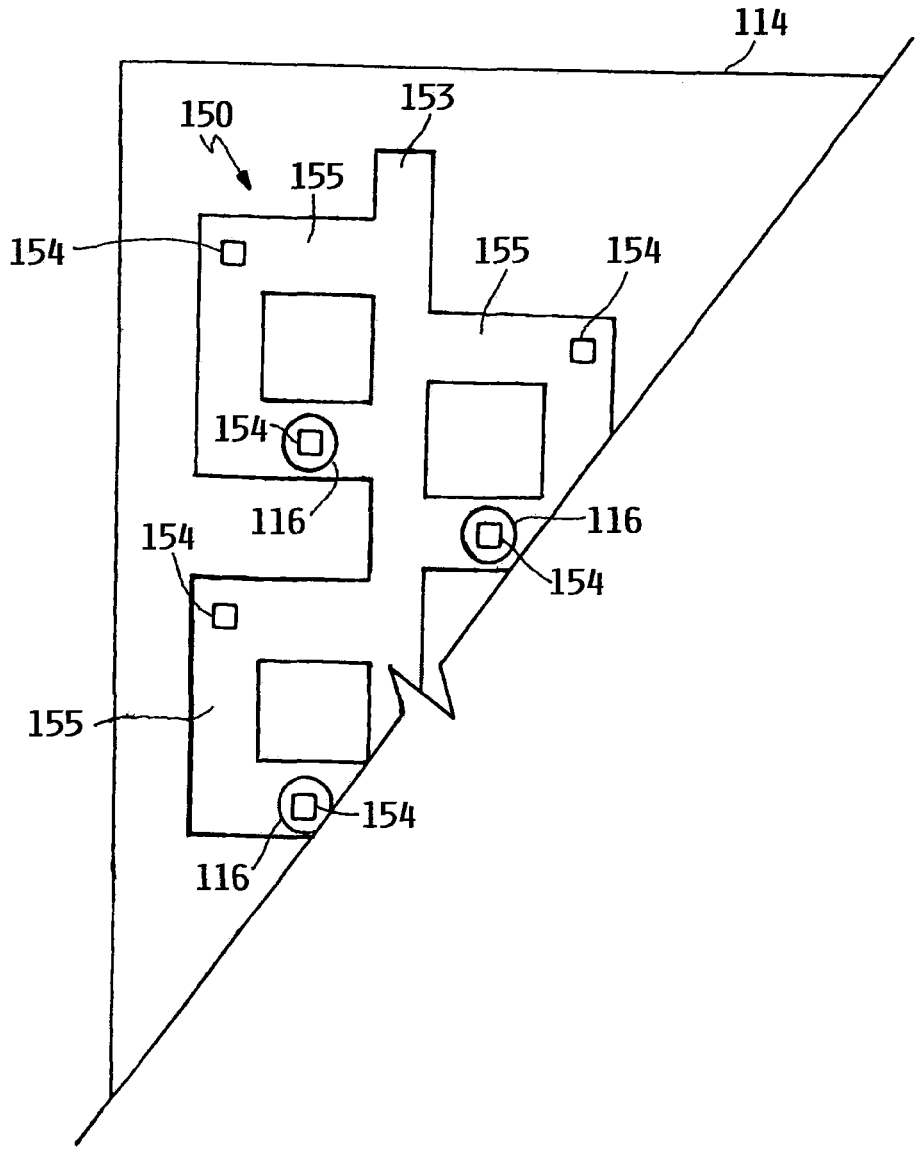
FIG. 6 is a block and schematic diagram generally illustrating a portion of a fluid ejection device, according to one example.

FIG. 5 is a graph 196 illustrating examples of known thermal response curves during a firing operation of a fluid chamber 150, and representing known operating conditions thereof. Curve 197 represents an example thermal response of a fluid chamber 150 that has no defects and is operating properly. Curve 198 represents an example thermal response of a fluid chamber 150 that is 60% blocked. In FIG. 6, firing resistor 154 ceases heating fluid 156 in vaporization chamber 152 at approximately 6 μs, at which time a drive bubble 160, if formed, is expected to have collapsed upon ejection or recirculation of fluid 156 from vaporization chamber 152. A fluid chamber 150 which is blocked to some degree will have a slower cooling rate than a "healthy" fluid chamber that is operating properly due to a slower or lack of fluid refill of vaporization chamber 152, as illustrated by curve 198 having a higher temperature than curve 197 after firing resistor 154 has ceased heating operations.

Returning to the example described above with respect to FIG. 4, if a $V_{DBD}$ measurement taken at 6.5 μs after the beginning of a firing operation has a value of 1.1, it may be difficult to determine with certainty from the $V_{DBD}$ measurement alone as to whether the fluid chamber 150 has no defects (curve 191) or whether the fluid chamber 150 has an orifice that is 60% blocked (curve 192). However, if a thermal response measurement, $V_{TH}$, is also taken of the fluid chamber 150 during a firing operation, say at 8.5 μs after the beginning of a firing operation, it is clear from curves 197 and 198 whether the fluid chamber 150 is operating normally or is defective. For example, if the thermal measurement is representative of curve 197, which is indicative a healthy fluid chamber, the $V_{DBD}$ measurement is determined to also be indicative of a healthy fluid chamber (e.g., curve 191 in FIG. 4). However, if the thermal measurement is representative of curve 198, the $V_{DBD}$ measurement is determined to be indicative of a 60% nozzle blockage of the fluid chamber (e.g., curve 192 in FIG. 4).

In view of the above, while a thermal response may not provide as much information as to a particular condition of a fluid chamber (e.g., whether a nozzle is partially or completely blocked), the thermal response provides a reliable—indication of whether a fluid chamber is "healthy" or is operating with some type of defect. By combining a thermal response with a measured DBD voltage response (where a DBD voltage response provides another indication of particular operating conditions/defects), in accordance with the present disclosure, an improved and more complete assessment of nozzle operating conditions is provided than when relying on DBD voltage response alone. As described above, by accurately determining fluid chamber operating conditions, a fluid ejection system (e.g., fluid ejection system 100 of FIG. 2) may implement servicing procedures to repair defective fluid chambers 150 or remove such fluid chambers from service, and compensate by adjusting firing patterns of remaining fluid chambers, for instance.

FIG. 6 is a block and schematic diagram generally illustrating a portion of a fluid ejection device, such as fluid ejection device 114, according to one example. Fluid ejection device 114 includes a plurality of fluid chambers 150 in communication with fluid slot 153 via fluid passages 157. Fluid chambers 150 include ejection type chambers (or nozzles) 200 and non-ejection type chambers (or pumps) 202, with nozzles 200 and pumps 202 each including drive bubble formation mechanisms 160 (e.g., firing resistors 160), and with nozzles 200 further including an orifice 116 through which fluid drops are ejected.

Figure 7:
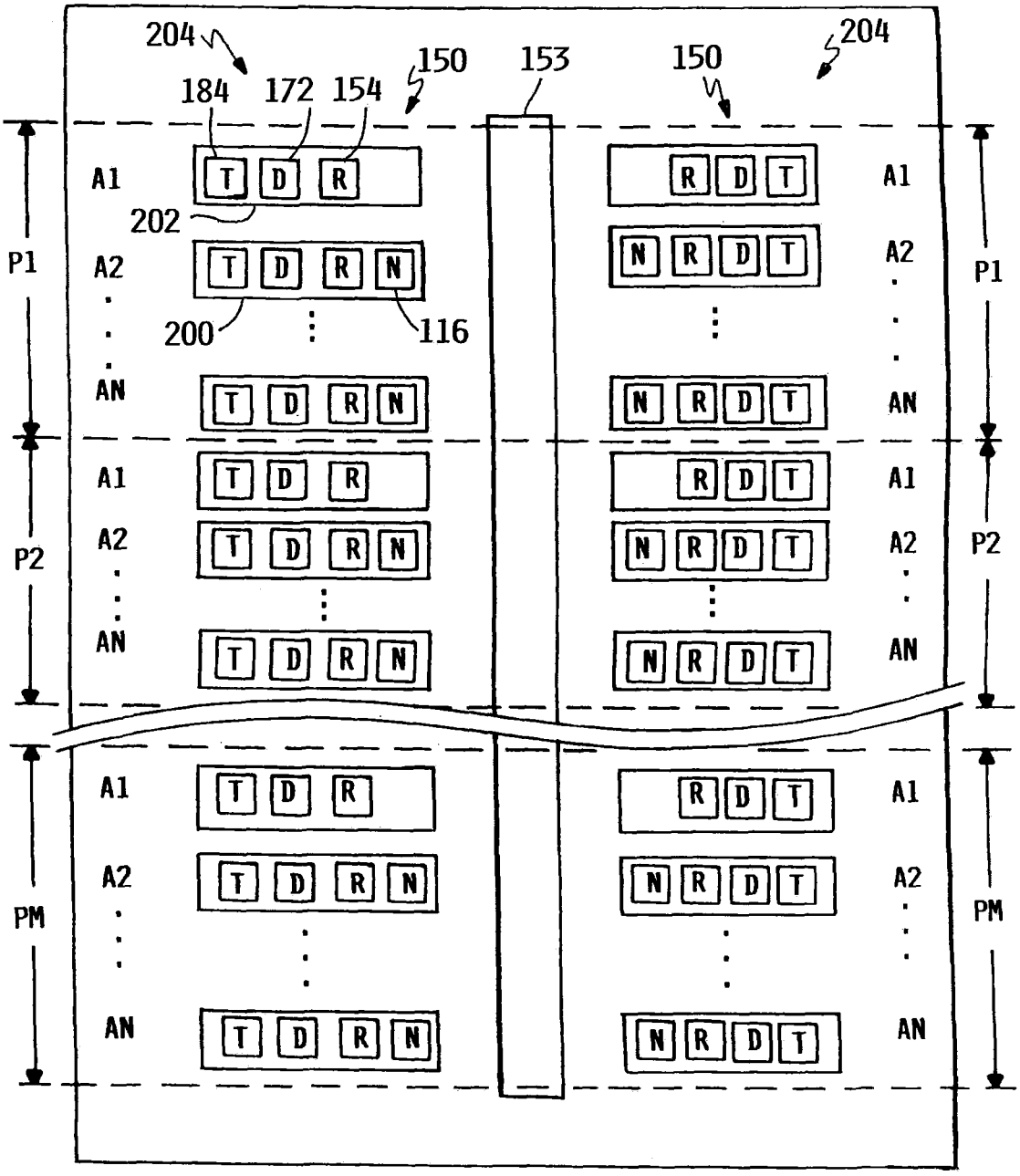
FIG. 7 is a block and schematic diagram generally illustrating portions of a fluid ejection device combining drive bubble detect and thermal response, according to one example.

FIG. 7 is a block and schematic diagram generally illustrating an example of fluid ejection device 114, including fluid chambers having DBD and thermal sensing, in accordance with the present disclosure. Fluid ejection device 114 includes a number of number of fluid chambers 150, including nozzles 200 (i.e., ejection type chambers) and pumps 202 (i.e., non-ejection type chambers) arranged in columns or column groups 204 on each side of a fluid slot 153 (see FIGS. 3A and 3B, e.g.). Each ejection chamber 150 includes a firing resistor 154, a DBD sense plate 172, and a thermal sense element 184 (e.g., a thermal diode 184), with nozzles 200 further including an orifice 116.

In the example of FIG. 7, each primitive includes "N" fluid chambers 150, where N is an integer value (e.g. N=8). Each primitive employs a same set of N addresses 206, illustrated as addresses A1 to AN, with each fluid chamber 150, along with its orifice 116, firing resistor 154, DBD sense plate 172, and thermal diode 184, corresponding to a different address of the set of addresses 208 so that, as described below, each ejection chamber 150 can be separately controlled within a primitive 180.

Although illustrated as each having the same number N ejection chambers 150, it is noted that the number of ejection chambers 150 can vary from primitive to primitive. Additionally, although illustrated as having only a single fluid slot 154 with nozzle column groups 178 disposed on each side thereof, it is noted that fluid ejection devices, such as fluid ejection device 114, may employ multiple fluid slots and more than two nozzle column groups. Additionally, while illustrated as being arranged in columns along fluid slots, fluid chambers 150 and primitives may be arranged in other configurations, such as in an array where the fluid slot 153 is replaced with an array of fluid feed holes, for instance.

Figure 8:
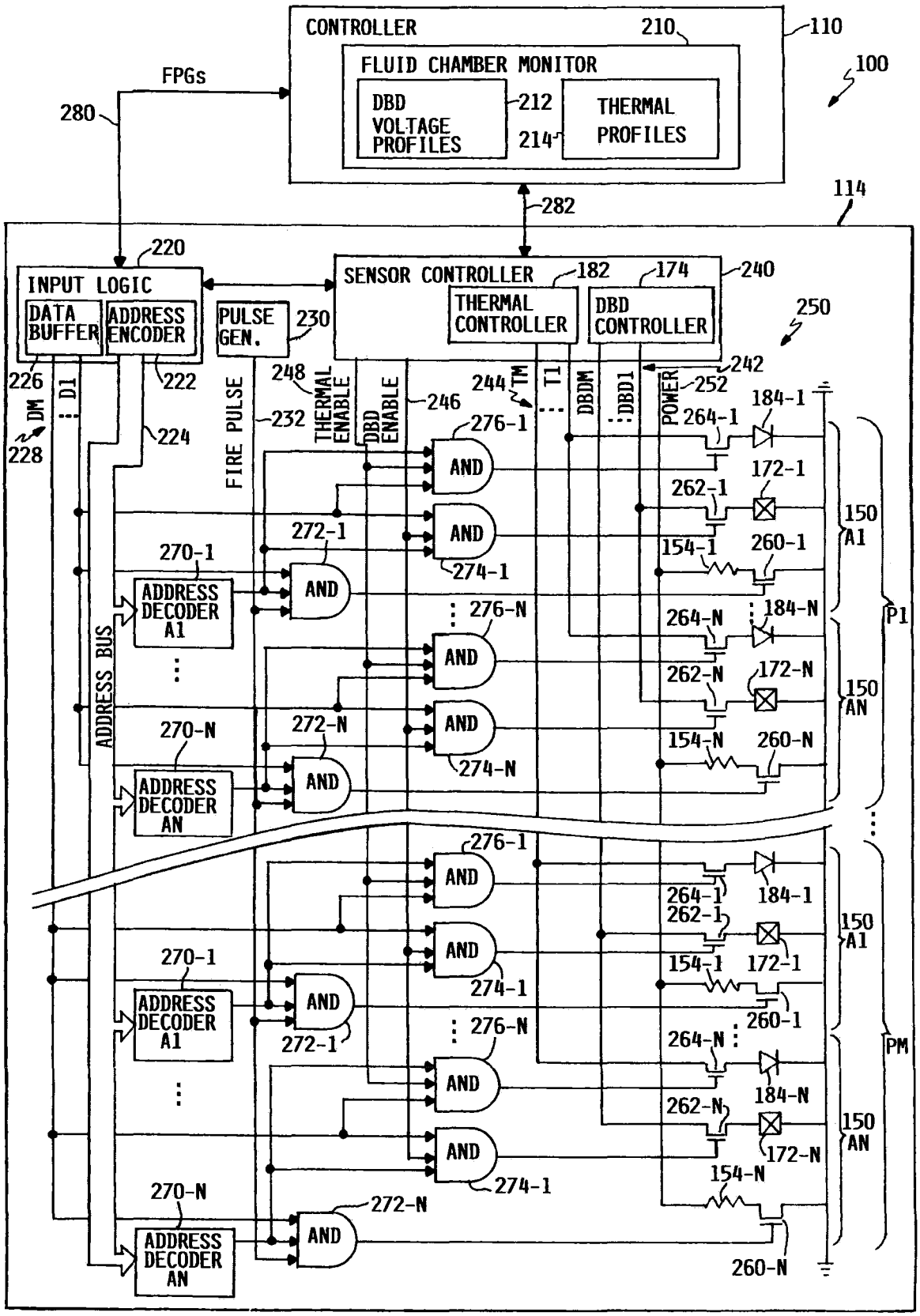
FIG. 8 is a block and schematic diagram generally illustrating a fluid ejection system including a fluid ejection device and combining drive bubble detect and thermal response, according to one example.

FIG. 8 is a block and schematic diagram generally illustrating portions of fluid ejection system 100 including an electronic controller 110 and a fluid ejection device 114 having fluid chambers 150 providing both DBD voltage response and thermal response for evaluation of fluid chamber operating conditions, according to one example of the present disclosure. According to one example, electronic controller 110 (see FIG. 2, for example) includes a nozzle monitor 210, with nozzle monitor 210 including a number of DBD voltage profiles 212 (such as illustrated by FIG. 4, for example) and a number of thermal profiles 214 (such as illustrated by FIG. 5, for example) which indicative of a number of known operating conditions of fluid chambers 150. In one example, DBD voltage profiles 212 and thermal profiles 214 may be determined at manufacture of fluid ejection system 100. In one example, DBD voltage profiles 212 and thermal profiles 214 may be developed during operation of fluid ejection system 100.

According to the illustrated example, fluid ejection device 114, includes a column 204 of fluid chambers 150 grouped to form a number of primitives, illustrated as primitives P1 to PM, with each fluid chamber 150 including a firing resistor 154, a DBD sense plate 172, and a thermal sense element, illustrated as a thermal diode 184. In the illustrated example, each primitive, P1 to PM, has a same set of addresses, illustrated as addresses A1 to AN, with each fluid chamber 150 of each primitive corresponding to a different one of the addresses of the set of address Fluid ejection device 114 includes input logic 220 including an address encoder 222 which encodes addresses of the set of addresses A1 to AN on an address bus 224, and a data buffer 226 which places ejection or firing data for firing resistors 154 received from controller 110 on a set of data lines 228, illustrated as data lines D1 to DM, with one data line corresponding to each primitive P1 to PM.

A pulse generator 230 generates a fire pulse signal 232 which causes a selected firing resistor 154 (based on address and firing data) to be energized for a time period that caused a drive bubble 160 to be formed and a fluid drop 158 to be ejected (e.g., when the fluid chamber 150 is configured as a nozzle 200).

A sensor controller 240 includes DBD controller 174 and thermal controller 182 (see FIGS. 3A and 3B, for example), where DBD controller 174 provides fixed DBD sensing current, $i_{DBD}$, to selected fluid chambers 150 and measures resulting DBD voltages, $V_{DBD}$, via a set of DBD sense lines 242, illustrated as sense lines DBD1 to DBDM, where each DBD sense line corresponds to a different one of the primitives, P1 to PM. Thermal controller 182 provides fixed thermal sensing current, $i_{TH}$, to the selected fluid chambers 50 and measures resulting thermal sensing voltages, $V_{TH}$, via a set of thermal sense lines 244, illustrated as sense lines T1 to TM, where each thermal sense line corresponds to a different one of the primitives, P1 to PM. In one example, as illustrated, thermal controller 182 provides DBD and thermal enable signals via corresponding enable lines 246 and 248.

Fluid ejection device 114 further includes activation logic 250 for energizing firing resistors 154, DBD sense plates 172, and thermal diodes 184 for ejecting fluid and measuring DBD voltage responses and thermal response of selected fluid chambers 150 in based on address data on address bus 224, on firing data on data lines D1 to DM, and on states of DBD and thermal enable signals 246 and 248. In the illustrated example, each fluid chamber 150 of each primitive, P1 to PM, includes firing resistor 154 (illustrated as firing resistors 154-1 to 154-N) coupled between a power line 252 and a ground line 254 via a controllable switch 260, such as a field effect transistor (illustrated as FETs 260-1 to 260-N). Each fluid chamber 150 of each primitive further includes DBD sense plate 172 (illustrated as DBD sense plate 172-1 to 172-N) coupled between power line 252 and ground line 254 via a controllable switch 262 (illustrated as FETs 262-1 to 262-N), and thermal diode 184 (illustrated as thermal diodes 184-1 to 184-N) coupled between power line 252 and ground line 254 via a controllable switch 264 (illustrated as FETs 264-1 to 264-N).

Additionally, for each primitive P1 to PM, each fluid chamber 150 includes an address decoder 270 for the corresponding address (illustrated as address decoders 270-1 to 270-N) which is coupled to address bus 224, an AND-gate 272 (illustrated as AND-gates 272-1 to 272-N), an AND-gate 274 (illustrated as AND-gates 274-1 to 274-N), and an AND-gate 276 (illustrated as AND-gates 276-1 to 276-N).

For each fluid chamber 150, AND-gate 272 receives as inputs the output of the corresponding address decoder 270, the corresponding one of the data lines 228, and fire pulse signal 232, with the output of AND-gate 272 controlling the corresponding FET 260 controlling the corresponding firing resistor 154. For each fluid chamber 150, AND-gate 274 receives as inputs the output of the corresponding address decoder 270, the corresponding one of the data lines 228 (e.g. data line D1 for AND-gates 274 of primitive P1), and the thermal enable signal 248, with the output of AND-gate 274 controlling the corresponding FET 262 controlling the corresponding DBD sense plate 172. Also, for each fluid chamber 150, AND-gate 276 receives as inputs the output of the corresponding address decoder 270, the corresponding one of the data lines 228 and the DBD enable signal 246, with the output of AND-gate 276 controlling the corresponding FET 264 controlling the corresponding thermal diode 184.

In operation, according to one example, when performing fluid ejection operations, controller 110 provides firing data in the form of a series of fire pulse groups (FPGs) to fluid ejection device 114 via a communication path 280, for example, where each FPG group corresponds to one of the addresses of the set of addresses, A1 to AN, and includes a series of fire bits, each fire bit corresponding to a different one of the primitives, P1 to PM, and, thus, corresponding to a different one of the data lines D1 to DM. Upon input logic 220 receiving each FPG, address encoder 222 encodes the corresponding address on address bus 224, and data buffer 226 places each fire bit on the corresponding data line 228.

The encoded address on address bus 224 is provided to each address decoder 270-1 to 270-N of each primitive P1 to PM, each of the address decoders corresponding to the address encoded on address bus 224 providing an active output to corresponding AND-gates 272, 274, and 276. For example, if the encoded address on address bus 224 represents address A1, address decoders 270-1 of each primitive, P1 to PM, will provide an active output to corresponding AND-gates 272-1, 274-1, and 276-1. In a scenario where a fluid chamber monitoring procedure is not being performed, neither DBD enable signal 246 nor thermal enable signal 248 will be enabled, such that the outputs of AND-gates 274-1 and 276-1 will not be active, and neither DBD senor plate 172-1 nor thermal diode 184-1 will be coupled to corresponding sense lines DBD1 and T1. However, if firing data is present on corresponding data line D1 and fire pulse signal 232 is active, the output of AND-gate 272-1 will be activated and close the corresponding FET 260-1, thereby energizing firing resistor 154-1 to generate a drive bubble 160 in the corresponding vaporization chamber 152 and eject a fluid drop 158 (see FIG. 3B).

In one example, in a scenario where a fluid chamber monitoring procedure is to be performed, controller 110 provides a monitoring signal to sensor controller 240 including at least one address and firing data for fluid chambers 150 for which DBD and thermal sensing is to be performed. In one example, controller 110 provides such monitoring signal via communication path 280, via a communication path 282 (e.g., a serial I/O), or a combination thereof. In response to such monitoring signal, address encoder 222 encodes the address of the fluid chamber 150 to be monitored on address bus 224, and data buffer places the associated firing data on data lines 228.

The encoded address on address bus 224 is provided to each address decoder 270-1 to 270-N of each primitive P1 to PM, with each of the address decoders corresponding to the address encoded on address bus 224 providing an active output to corresponding AND-gates 272, 274, and 276. For example, if the encoded address on address bus 224 represents address A1, address decoders 270-1 of each primitive, P1 to PM, will provide an active output to corresponding AND-gates 272-1, 274-1, and 276-1.

If firing data is present on the corresponding data line D1, and fire pulse signal 232 is active, the output of AND-gate 272-1 will be activated and close the corresponding FET 260-1, thereby energizing firing resistor 154-1 to perform a firing operation and generate a drive bubble 160 in the corresponding vaporization chamber 152 and eject a fluid drop 158. In this case, with the output of address decoder 270-1 being active, with firing data present on data line D1, and with the DBD and thermal enable signals 246 and 248 also being active, the outputs of AND-gates 274-1 and 276-1 are also activated, thereby closing corresponding switches 262-1 and 264-1 and respectively coupling DBD sense plate 172-1 and thermal diode 184-1 to the DBD and thermal sense lines 242 and 244 corresponding the each primitive. For example, with respect to primitive P1, DBD sense plate 172-1 is coupled to DBD sense line DBD1, and thermal diode 184-1 is coupled to thermal sense line T1.

At a predetermined time during a firing operation, for example, after activation of the firing resistors 154-1 and at a point after drive bubble 170 is expected to have been formed (with reference to FIG. 4, say 3.5 μs after commencement of a firing operation, for example), DBD controller 174 and thermal controller 182 respectively provide fixed sense currents $i_{DBD}$ and $i_{TH}$ on DBD and thermal sense lines 242 and 244 and measure the generates voltage $V_{DBD}$ and $V_{TH}$ (see FIG. 3B, for example). In one example, DBD controller 174 and thermal controller 182 provide sense currents $i_{DBD}$ and $i_{TH}$ and measure values of $V_{DBD}$ and $V_{TH}$ at a same delay time after activation of firing resistor 154-1 by fire pulse signal 232. In one example, DBD controller 174 and thermal controller 182 provide sense currents $i_{DBD}$ and $i_{TH}$ and measure values of $V_{DBD}$ and $V_{TH}$ at different time delays time after activation of firing resistor 154-1 by fire pulse signal 232 (e.g. thermal controller 182 provides sense current $i_{TH}$ after sense current $i_{DBD}$ is provided by DBD controller 174). In one example, DBD controller 174 and thermal controller 182 measure the $V_{DBD}$ response and thermal response during different firing operations (e.g., over successive firing operations).

In one example, for each selected fluid chamber 150, sensor controller 240 provides the measured $V_{DBD}$ values and measured thermal values $V_{TH}$ to fluid chamber monitor 210, such as via data path 282. In one example, for each selected fluid chamber, fluid chamber monitor 210 compares the measured $V_{DBD}$ values and measured thermal values $V_{TH}$ to known DBD voltage profiles 212 and known thermal profiles 214 which are representative of known operating conditions of a fluid chamber 150, such as illustrated and described above with respect to FIGS. 3A, 3B, 4, and 5. In one example, after determining an operating condition for a selected fluid chamber 150, fluid chamber monitor provides a status of the operating condition to controller 110, where controller 110, if the fluid chamber 150 is indicated as having some type of defect, may implement servicing procedures or remove the fluid chamber 150 from service and compensate by adjusting firing patterns of remaining fluid chambers 150, for instance. In one example, fluid chamber monitor 210 sequentially directs the performance DBD and thermal response measurements for each fluid chamber 150 of fluid ejection device 114 so that, over time, such as over the course of an ejection operation (e.g., a print job in the case of fluid ejection device 114 being implemented as an inkjet printhead), so that the operating conditions of all fluid chambers 150 can be continually monitored and updated.

In the example of FIG. 8, DBD sense plates 172 and thermal diodes 184 are illustrated as being coupled to separate DBD and thermal sense lines 242 and 244. In other examples, DBD sense plates 172 and thermal diodes 184 may share a single sense line, where activation and injection of sense currents through DBD sense plates 172 and thermal diodes 184 are performed sequentially via control of switches 262 and 264 via AND-gates 274 and 276. Additionally, although the example of FIG. 8 illustrates separate DBD enable and thermal enable signals 242 and 244, as well as corresponding AND-gates 274-1 and 276-1, in other examples, in lieu of such a duel configuration, a single enable signal and corresponding AND-gate may be used to simultaneously control switches 262 and 264 controlling the activation of DBD sense plate 172 and thermal diode 184. Any number of other implementations are possible, such as using a single sense line for all primitives, P1 to PM, in lieu of a separate sense line for each primitive, as illustrated by FIG. 8.

Additionally, although fluid chamber monitor 210 is illustrated as being implemented as part of controller 110, it is noted that, in other examples, all or portions of logic for fluid chamber monitor 210 may be implemented as part of fluid ejection device 114 or controller 110, or in some combination thereof.

Figure 9:
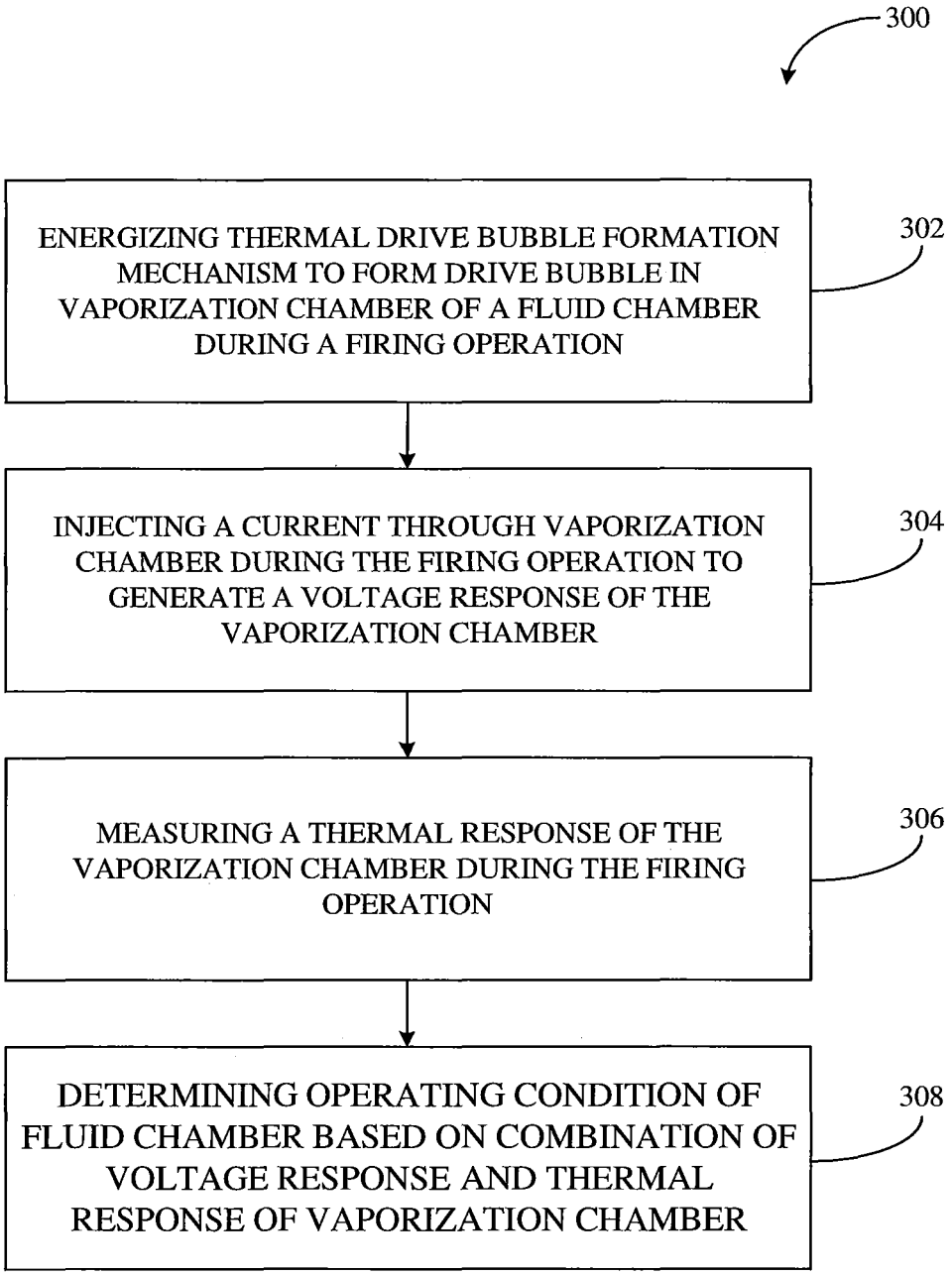
FIG. 9 is a flow diagram generally illustrating a method of operating a fluid ejection device combining drive bubble detect and thermal response, according to one example.

FIG. 9 is a flow diagram generally illustrating a method 300 of operating a fluid ejecting device, such as fluid ejection device 114, including a fluid ejection chamber such as fluid ejection chamber 150 of FIGS. 3A and 3B, according to one example of the present disclosure. At 302 method 300 includes energizing a thermal drive bubble formation mechanism to vaporize a portion of a fluid in a vaporization chamber of a fluid chamber to form a drive bubble during a firing operation of the fluid chamber, such as energizing firing resistor 154 to form a drive bubble 160 from fluid 156 in vaporization chamber 152 of fluid chamber 150 during a firing operation, as illustrated by FIGS. 3A and 3B, for example.

At 304, a current is injected through the vaporization chamber during the firing operation to generate a voltage signal representing a voltage response of the vaporization chamber, such as DBD controller 174 injecting sense current $i_{DBD}$ through vaporization chamber 152 via DBD sense plate 172 along impedance path 178 to generate DBD voltage, $V_{DBD}$, as illustrated by FIG. 3B, and which is representative of a voltage response, such as illustrated by the curves of FIG. 5, for example.

At 306, method 300 includes measuring a thermal response of the vaporization chamber during the firing operation, such as by thermal controller 182 injecting sense current $i_{TH}$ through thermal sense element 184 (e.g., a thermal diode) to generate voltage, $V_{TH}$, which is representative of the thermal response of vaporization chamber 152, as illustrated by FIG. 3B and the example thermal response curves of FIG. 6.

At 308, method 300 includes determining an operating condition of the fluid chamber based on the voltage response and the thermal response of the vaporization chamber, such as fluid chamber monitor 210 (see FIG. 8) comparing measured values of the voltage response, $V_{DBD}$, and the thermal response, $V_{TH}$, to known voltage and thermal response profiles representing known conditions of fluid chambers 150, as illustrated and described with respect to know voltage and temperature response curves of FIGS. 4, and 5, for example.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fluid ejection device comprising:

a fluid chamber including:

a vaporization chamber; and a thermal drive bubble formation mechanism to vaporize a portion of a fluid in the vaporization chamber to form a drive bubble in response to a firing signal during a firing operation;

a drive bubble detect sensor separate from the thermal drive bubble formation mechanism and in contact with fluid in the vaporization chamber, the drive bubble detect sensor to inject a fixed current through the vaporization chamber to generate a first voltage signal representing a voltage response of the vaporization chamber and indicative of drive bubble formation during the firing operation; and a thermal sensor to generate a second voltage signal indicative of a thermal response of the vaporization chamber during the firing operation, the first and second voltage signals combined being representative of an operating condition of the fluid chamber.

2. The fluid ejection device of claim 1, including:

control logic to:

measure a voltage value of the first voltage signal at a time during the firing operation when a drive bubble is expected to have been formed;

measure a voltage value of the second voltage signal to determine a temperature value of the thermal response of the vaporization temperature at a time during the firing operation; and compare the measured voltage value to a plurality of known voltage response profiles representing known fluid chamber operating conditions and compare the measured temperature value to known fluid chamber thermal response profiles to identify an operating condition of the fluid chamber.

3. The fluid ejection device of claim 1, the thermal sensor including a thermal sense element separate from the thermal drive bubble formation mechanism, the thermal sensor to inject a fixed current through the thermal sense element to generate a second voltage signal.

4. The fluid ejection device of claim 3, the vaporization chamber disposed in a substrate, the thermal sense element disposed in a substrate layer below the vaporization chamber such that the thermal drive bubble formation mechanism is disposed between the vaporization chamber and the thermal sense element.

5. The fluid ejection device of claim 3, including a plurality of fluid chambers, and including:

a drive bubble detect sense line selectively connectable to the drive bubble detect sensor of each fluid chamber to carry the first voltage signal; and a thermal sense line selectively connectable to the thermal sense of each fluid chamber to carry the second voltage signal.

6. A fluid ejection system comprising:

a fluid ejection device including:

a plurality of fluid chambers, each fluid chamber including:

a vaporization chamber;

a thermal drive bubble formation mechanism to vaporize a portion of a fluid in the vaporization chamber to form a drive bubble during a firing operation;

a drive bubble sense element separate from the thermal drive bubble formation mechanism and in contact with the fluid; and a thermal sense element; and a sense controller to:

inject a fixed current through the vaporization chamber via the drive bubble sense element of a selected fluid chamber during a firing operation to generate a first voltage signal representing a voltage response of the vaporization chamber and indicative of the formation of a drive bubble;

inject a fixed current through the thermal sense element of the selected fluid chamber to generate a second voltage signal indicative of a thermal response of the vaporization chamber during the firing operation; and a fluid chamber monitor to determine an operating condition of the selected fluid chamber based on the voltage response and the thermal response of the vaporization chamber combined.

7. The fluid ejection system of claim 6, the sense controller to:

measure a voltage value of the voltage response of the selected fluid chamber a time during the firing operation when a drive bubble is expected to have been formed; and measure a temperature value of the thermal response of the vaporization temperature at a time during the firing operation; and the fluid chamber monitor to:

compare the measured voltage value to a plurality of known voltage response profiles representing known fluid chamber operating conditions;

compare the measured temperature value to known fluid chamber thermal response profiles; and identify an operating condition of the fluid chamber based on the comparisons.

8. The fluid ejection system of claim 6, the fluid ejection device including:

a drive bubble detect sense line selectively connectable to the drive bubble sense element, the drive bubble detect sense line to carry the fixed current to the drive bubble sense element of the selected fluid chamber and to provide the first voltage signal; and a thermal sense line selectively connectable to the thermal sense element of each fluid chamber, the thermal sense line to carry the fixed current to the thermal sense element of the selected fluid chamber and to provide the second voltage signal.

9. The fluid ejection system of claim 6, the plurality of fluid chambers arranged in a plurality of primitives, the fluid ejection device including:

a drive bubble detect sense line for each primitive, the drive bubble detect line of each primitive selectively connectable to the drive bubble sense elements of each fluid chamber of the primitive, the drive bubble detect sense line to carry the fixed current to the drive bubble sense element of the selected fluid chamber and to provide the first voltage signal; and a thermal sense line for each primitive, the thermal sense line of each primitive selectively connectable to the thermal sense element of each fluid chamber of the primitive, the thermal sense line to carry the fixed current to the thermal sense element of the selected fluid chamber and to provide the second voltage signal.

10. A method of operating a fluid ejection device comprising:

energizing a thermal drive bubble formation mechanism to vaporize a portion of a fluid in a vaporization chamber of a fluid chamber to form a drive bubble during a firing operation of the fluid chamber;

injecting a current through the vaporization chamber during the firing operation to generate a voltage signal representing a voltage response of the vaporization chamber;

measuring a thermal response of the vaporization chamber during the firing operation; and determining an operating condition of the fluid chamber based on the voltage response and the thermal response of the vaporization chamber.

11. The method of claim 10, determining an operating condition including:

measuring a voltage value of the voltage response at a time during the firing operation when a drive bubble is expected to have been formed;

measuring a temperature value of the thermal response of the vaporization chamber at a time during the firing operation;

comparing the measured voltage value to a plurality of known voltage response profiles representing known fluid chamber operating conditions and comparing the measured temperature value to known fluid chamber thermal response profiles to identify an operating condition of the fluid chamber.

12. The method of claim 11, including measuring the temperature value at a same time during the firing operation as measuring the voltage value of the voltage signal.

13. The method of claim 12, including measuring the temperature value at a time different from the time at which the voltage value is measured.

14. The method of claim 13, including measuring the temperature value at a time during the firing operating after which a drive bubble is expected to have collapsed.

15. The method of claim 10, the vaporization chamber being disposed in a substrate, measuring the thermal response including:

disposing a thermal sense element in the substrate below the vaporization chamber, the thermal sense element separate from the thermal drive bubble formation mechanism; and injecting a fixed current through the thermal sense element to generate a voltage signal representative of a temperature of the vaporization chamber.

* * * * *